US007083440B2

(12) United States Patent
Shen et al.

(10) Patent No.: US 7,083,440 B2
(45) Date of Patent: Aug. 1, 2006

(54) CARD CONNECTOR

(75) Inventors: Guojian Shen, Kunsan (CN); Ren-Chih Li, Tu-chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/165,761

(22) Filed: Jun. 24, 2005

(65) Prior Publication Data

US 2006/0110959 A1 May 25, 2006

(51) Int. Cl.
*H01R 13/44* (2006.01)

(52) U.S. Cl. ..... 439/138; 439/630

(58) Field of Classification Search ..... 439/138, 439/630, 632, 541.5, 136
See application file for complete search history.

(56) References Cited

U.S. PATENT DOCUMENTS 5,372,515 A * 12/1994 Miller et al. ..... 439/138
5,591,047 A * 1/1997 Yamada et al. ..... 439/541.5
5,713,747 A * 2/1998 Hsia et al. ..... 439/79
5,716,224 A * 2/1998 Masuda et al. ..... 439/138
6,062,904 A * 5/2000 Oguchi et al. ..... 439/541.5
6,666,724 B1 * 12/2003 Lwee ..... 439/630
6,669,493 B1 * 12/2003 Kuroda ..... 439/159
6,685,362 B1 * 2/2004 Burkholder et al. ..... 385/78
6,757,173 B1 * 6/2004 Yamaguchi ..... 361/752
6,991,492 B1 * 1/2006 Ho et al. ..... 439/541.5
2005/0164559 A1 * 7/2005 Shimizu et al. ..... 439/630

* cited by examiner

*Primary Examiner*—Tulsidas C. Patel
*Assistant Examiner*—Phuongchi Nguyen
(74) *Attorney, Agent, or Firm*—Wei Te Chung

(57) ABSTRACT

A card connector comprises an insulating housing defining a card receiving space for accommodating two kinds of different cards in size; a plurality of contacts retained in the housing, an anti-misinsertion appliance disposed in the housing, and comprising a shutter member and an actuator member for controlling the shutter member to open and close and the actuator formed with a locking hole for engaging with a mating portion of the shutter member and having a guiding slope extending from the second card cavity to the first card cavity; and when the actuator member is moved outwardly from the card receiving space because of an outer force, the shutter member can open the card receiving space completely for receiving the corresponding card.

7 Claims, 9 Drawing Sheets

CARD CONNECTOR

BACKGROUND OF THE INVENTION

1. Field of the Invention

The present invention relates to a card connector, especially to a card connector which has anti-misinserting appliances. The instant application relates to two contemporaneously filed applications each having the same applicant, the same title and the same assignee with the instant application.

2. Description of Related Art

With development of electrical appliances such as portable telephones, digital cameras, PDA (personal digital assistance), portable audio and the like, a lot of different kinds of cards such as a SD (super density, secure digital) card, a CF (compact flash) card, a MMC (multimedia card), a MS (memory stick) card, a MS Duo (memory stick duo) card and an XD (xd-picture) card are widely used in the field of the electronics. Because different cards have different external dimensions, thus different card connectors are needed loading corresponding different cards. However, if one card connector can only load one card, more cards are needed more card connectors to load, thus occupying a lot of areas of the electrical appliances and interfering with downsizing of the electrical appliances. Thus a card connector which can load some different cards simultaneously is accomplished.

U.S. Pat. No. 6,386,920 discloses a card connector which can load some different cards. The connector defines a card receiving space which is divided into some different card cavities for receiving an SM card, a MMC, an SD card and a MS card. That is to say, though the SM card, the MMC, the SD card and the MS card have their own card cavity, these card cavities are in a card receiving space. Especially, thus the MMC is easily inserted into the inserting cavity of the SD card because of misinsertion, then damaging the card connector.

Hence, an improved card connector is required to overcome the disadvantages of the prior art.

SUMMARY OF THE INVENTION

An object of the present invention is to provide a card connector which can prevent misinsertion of cards.

Accordingly, to achieve above-mentioned object, a card connector comprises an insulating housing defining a card receiving space for accommodating two kinds of different cards in size; a plurality of contacts retained in the housing and comprising a first and second contacting portions exposed in the card receiving space for electrically connecting with the different cards respectively; an anti-misinsertion appliance disposed in the housing, and comprising a shutter member and an actuator member for controlling the shutter member to open and close and the actuator formed with an engaging hole for engaging with a mating portion of the shutter member and having a guiding slope extending from the second card cavity to the first card cavity; and when the actuator member is moved out from the card receiving space because of an outer force, the shutter member can open the card receiving space completely for receiving the corresponding card.

The detailed features of the present invention will be apparent in the detailed description with appropriate reference to the accompanying drawings.

DETAILED DESCRIPTION OF THE INVENTION

As shown in FIGS. 1 to 10, the card connector 1 of the present invention can be used commonly for a thin, short, small card such as a MS Duo card and a thick, long, large card such as a MS card. The present invention, however, is not limited to the use of these cards but also be applied satisfactorily to other memory cards such as SD cards and IC cards.

Figure 1:
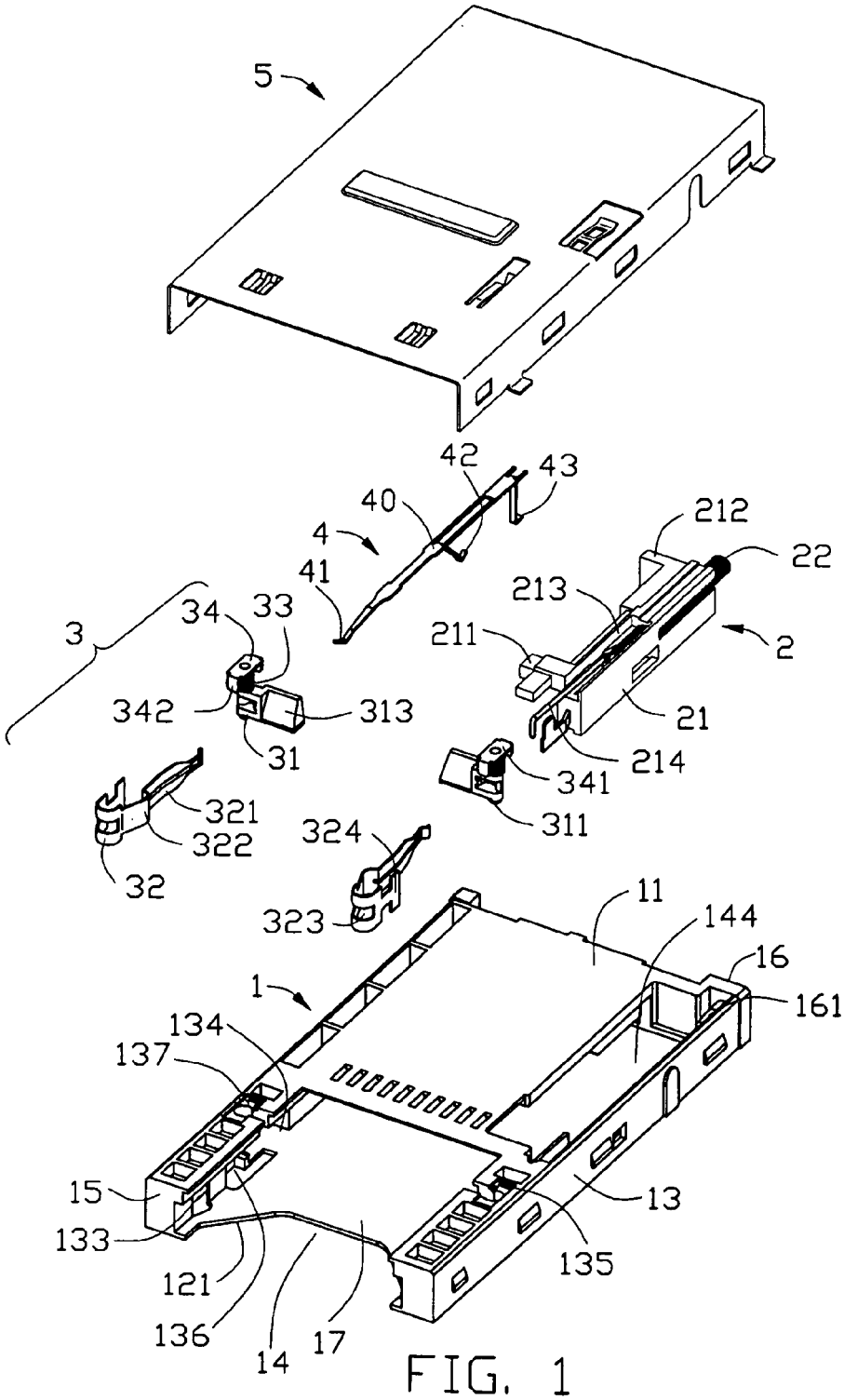
FIG. 1 is an exploded perspective view of the card connector in accordance with the present invention.
Figure 2:
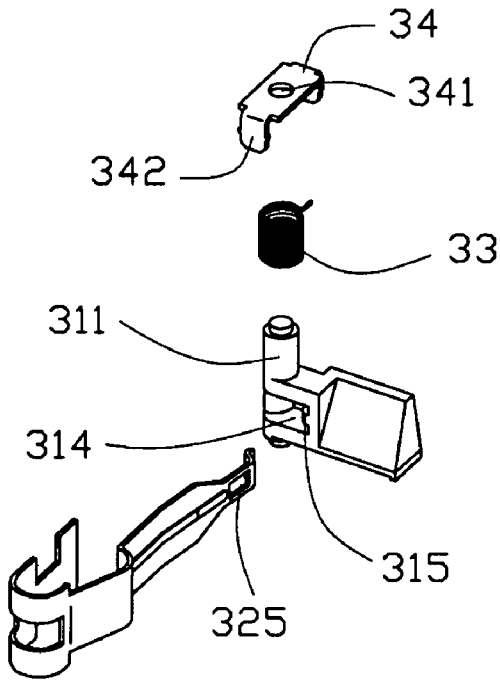
FIG. 2 is an exploded perspective view of an anti-misinserting appliance of the card connector shown in FIG. 1.
Figure 3:
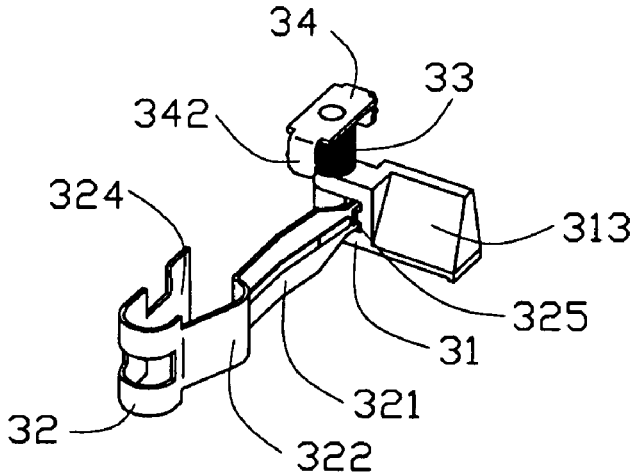
FIG. 3 is an assembled perspective view of the anti-misinserting appliance of the card connector shown in FIG. 2.
Figure 4:
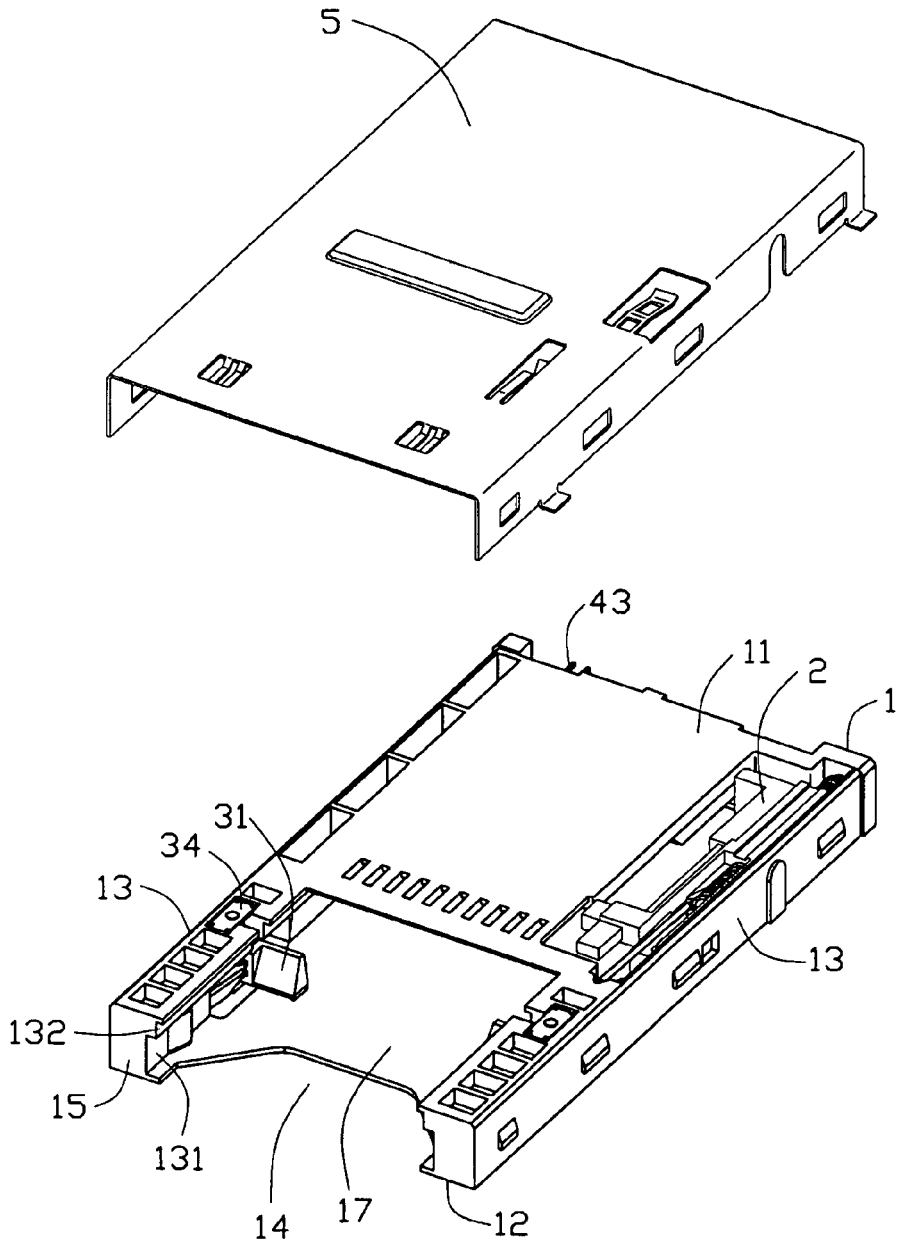
FIG. 4 is a partly assembled perspective view of the card connector shown in FIG. 1 with a shield member disassembled from the housing.

Referring to FIG. 1, the card connector of the present invention comprises an insulating housing 1, an ejector 2, an anti-misinsertion appliance 3, a plurality of electrical contacts 4 and a shielding member 5.

The housing 1 is approximately box-shaped and the shielding member 5 is used in combination with the housing 1. The housing 1 defines a card receiving space (not labeled) among an end wall 16, a pair of side walls 13, a top wall 11 and a bottom wall 12 thereof. The top wall 11 is approximately formed on rear part of the housing 1. The housing 1 is opened at a front face 15 thereof to form a card insertion opening 17 and defines a card insertion direction along a front-rear direction. The housing 1 formed with a step portion (not labeled) therein to divide the card receiving space into a small card cavity 132 served as a first card cavity and a large card cavity 131 served as a second card cavity, the small card cavity 132 and the large card cavity 131 are aligned along a vertical direction perpendicular to the card insertion direction. An echelon slot 14 is formed on the bottom wall 12 adjacent to the card insertion opening 17.

On both side walls 13 of the housing 1 adjacent to the card insertion opening 17, the anti-mininserion appliance 3 is arranged to face each other with the card insertion opening 17 interposed therebetween. The anti-misinsertion appliance 3 comprises an actuator member 32 and a shutter member 31 both performed a switching operation according to a difference in size, such as thickness, width or length, between the small card and the large card.

Referring to FIG. 1, the contacts 4 are assembled into the housing 1 from the end wall 16 thereof. Each of the electrical contacts 4 comprises a horizontal portion 40, a first contacting portion 41 extending toward the card insertion opening 7 from one end of the horizontal portion 41, a soldering portion 43 extending perpendicularly beyond the end wall 16 of the housing 1 from another end of the horizontal portion 41 and a second contacting portion 42 punched from the horizontal portion 41. The second contacting portion 42 is located between the first contacting portion 41 and the soldering portion 43 and extends slantways toward the bottom wall 12 from the horizontal portion 40. The first contacting portions 41 are exposed in the small card cavity 132 and the second contacting portion 42 are exposed in the large card cavity 131. The first contacting portions 41 and the second contacting portion 42 are electrically connected with the small card such as the MS Duo card and the large card such as the MS card respectively.

Referring to FIGS. 1, 2, 3 and 4, The ejector 2 is secured at a rear corner 144 of the housing 1. A column 161 is formed on the end wall 16 and protrudes into the rear corner 144. The ejector 2 comprises a base body 21 and the ejector 2 is secured in the housing 1 in virtue of one end of a spring 22 set on the column (not labeled) of the housing 1 and opposite end thereof disposed in the ejector 2, and one end of a pin 214 locked on the base portion 21 and another end thereof locked on the side wall 13. A first protruding portion 212 and a second protruding portion 211 are formed on the base body 21 along the front-rear direction. The first protruding portion 212 is formed on end of base portion 21 adjacent to the end wall 22 and protrudes into the card receiving space. The second protruding portion 211 is T-shaped, disposed on opposite end of the base portion 21 and protruding into the small card cavity 132.

Referring to FIGS. 1, 2, 3, 4 and 8, The actuator member 32 and the shutter member 31 are received in a first apertures 133 and a second apertures 134 both defined at the side walls 1.3 of the housing 1, respectively. The anti-misinsertion appliance 3 comprises an actuator member 32 and a shutter member 31. The actuator member 32 is a piece of metal sheet. It comprises a protruding portion 322 protruding into the large card cavity 131 defined as an original position, an engaging portion 321 extending toward the second aperture 134 from one end of the protruding portion 322 to receive in a passage 136 defined at the side walls 13 for communicating the first aperture 133 and the second aperture 134, and a holding portion 324 extending from another end of the protruding portion 322 for securing in the housing 1 and the holding portion 324 is defined a hole 323. The actuator member 32 is formed with a locking hole 325 on end of the engaging portion 321 thereof. The shutter member 31 comprises a stopper 313 protruding into the large card cavity 131 defined as an original position, a pivoting axis 311, a spring 33, a locking member 34 and a receiving hole 314 located between the stopper 313 and the pivoting axis 311. A locking member 34 is provided with a pivoting hole 341 and a pair of securing portions 342 extending downward from lateral sides thereof. The pivoting hole 341 is connected with the pivot axis 311. The spring 33 are set on upper parts of the axis 311 of the shuttle member 31 and one end of the spring 33 is secured on the locking member 34 and another end is secured on the shutter member 31, and the shutter member 31 is provided with a mating portion 315 exposed in the pivoting hole 314. The engaging portion 321 of the actuator member 32 is received in the pivoting hole 314 and the mating portion 315 of the shutter member 31 is freely, fittly received in the locking hole 325 of the actuator member 32. When the large card in inserted, it will press the protruding portions 322 to pivot outward from the card receiving space, then make the mating portion 315 depart from the locking hole 325 to release the shutter member 31.

The locking members 34 are secured in rectangular slots 137 135 which are defined on top of the first apertures 133 and the second apertures 134 in virtue of securing portions 342 thereof. The protruding portions 322 of the actuator members 32 and the stoppers 313 of the shutter members 31 are arranged in turn along the card inserting direction and distance between the pair of protruding portions 322 is longer than that of the stoppers 313, that is to say, distance of the stoppers 313 protruding into the large card cavity is longer than that of the protruding portions 322.

Figure 5:
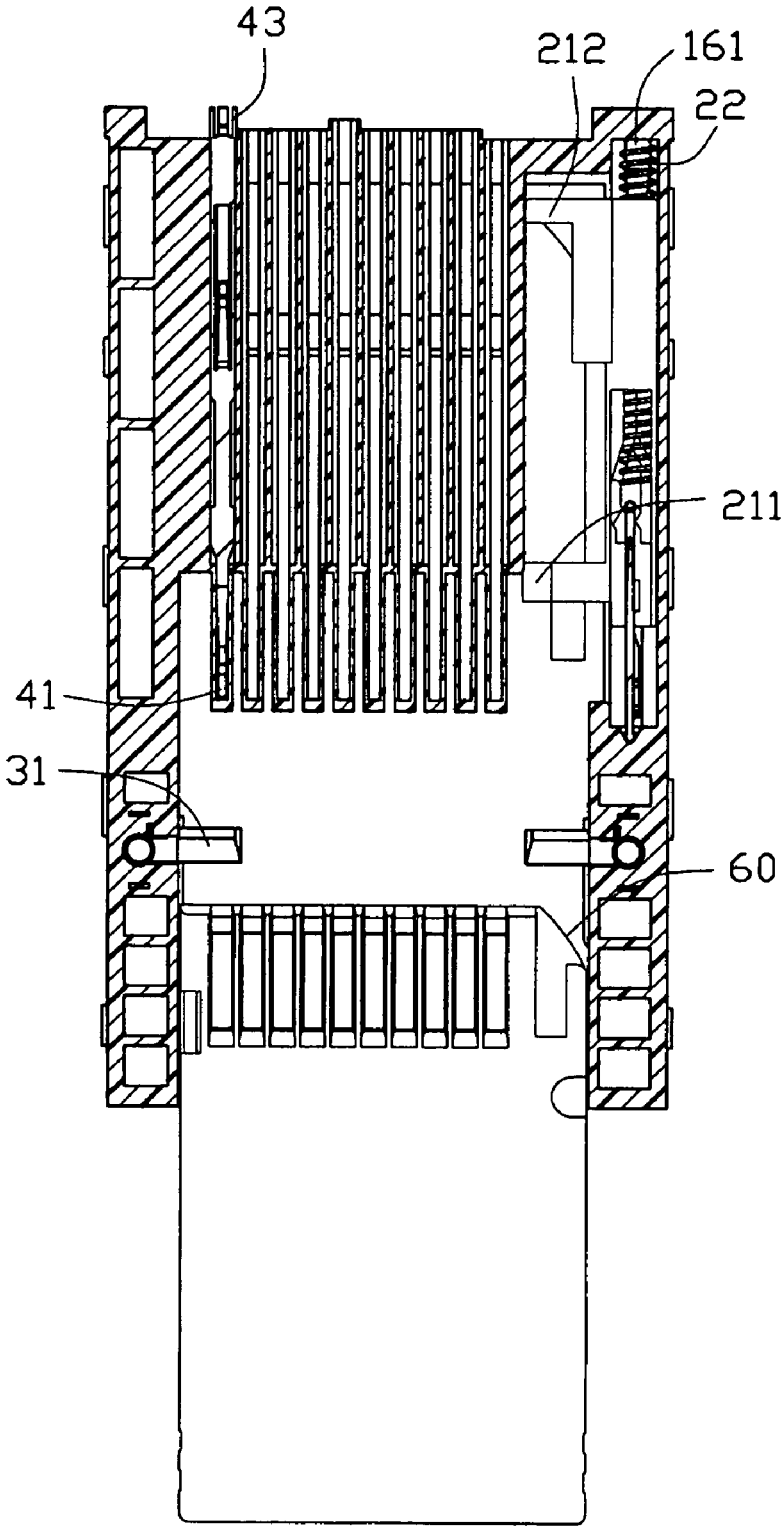
FIG. 5 is a cross-sectional view of the card connector shown in FIG. 1, showing original status of insertion of a small card.
Figure 6:
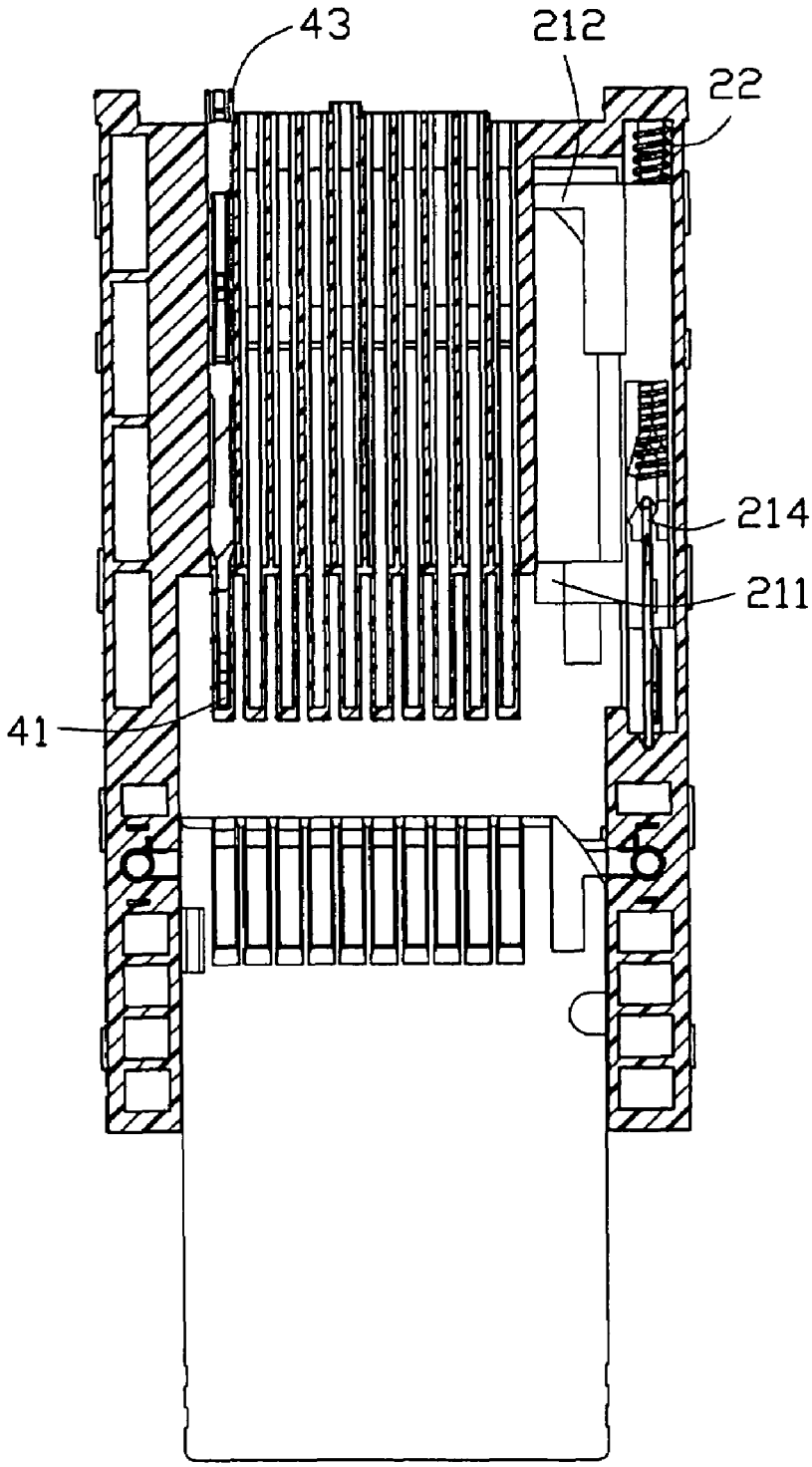
FIG. 6 is a cross-sectional view of the card connector shown in FIG. 1, showing status after the small card collides with a stopper.
Figure 7:
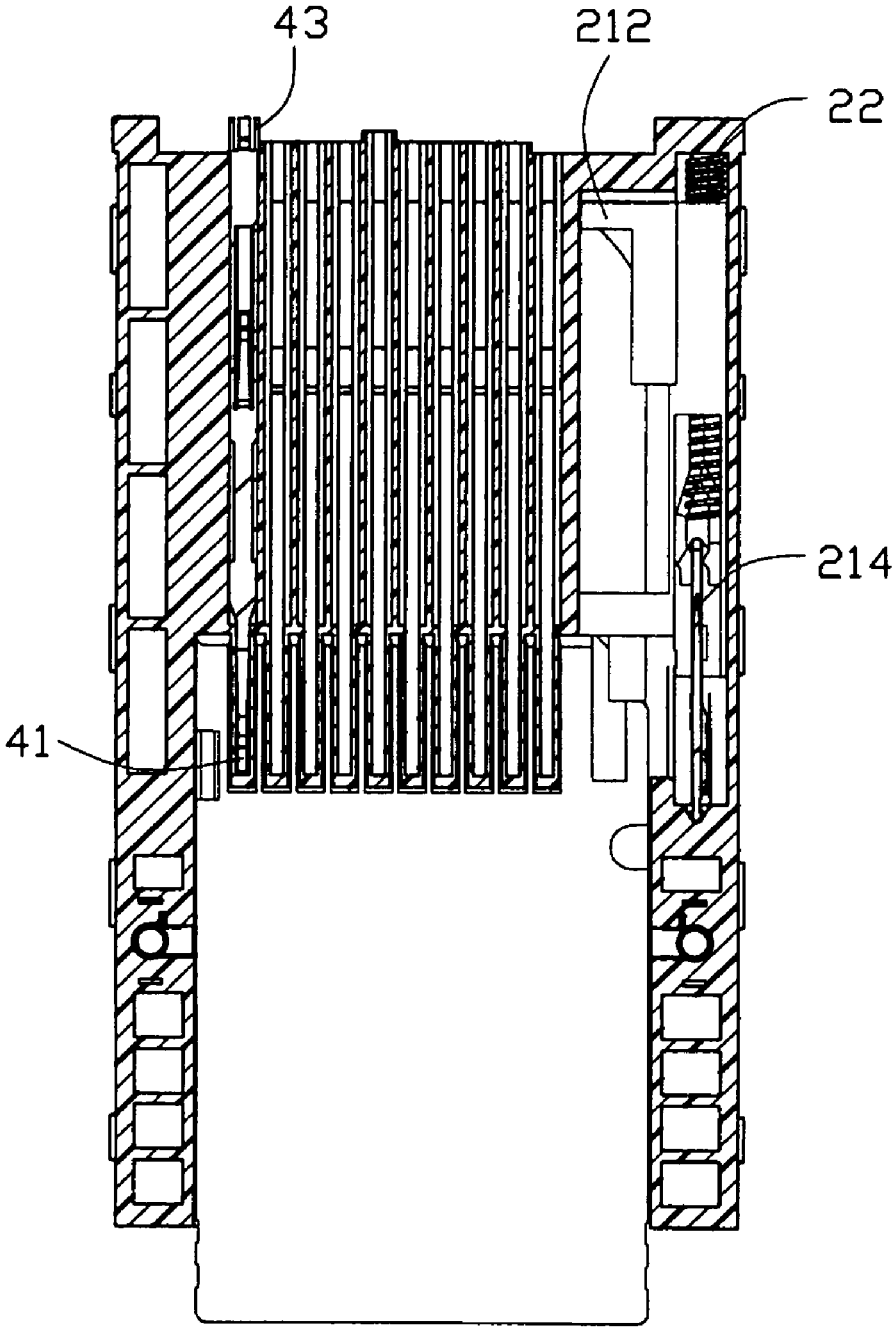
FIG. 7 is a cross-sectional view of the card connector shown in FIG. 1, showing final status of insertion of the small card.

Referring to FIGS. 5, 6 and 7, the small card such as MS Duo card has a width shorter than a normal distance between the pair of protruding portions 322 and the pair of stoppers 313 protrude into the large card cavity 131, so, when the small card is inserted along the small card cavity 132 from the card insertion opening 17, it can be inserted smoothly without any interference. Finally, the T-shaped protruding portion 211 of the ejector 2 engages with a corresponding concave (not labeled) of the small card and the small card electrically connects with the first contacting portion 41 of the contacts 4.

When the small card is inserted along the large card cavity 131 by mistake. Because the width of the small card is shorter than the normal distance between the pair of fist protruding portions 322, so, when the small card is inserted firstly, it does not contact the protruding portions 322. The small card advances further inward until it contacts the stoppers 313. The small card has a width larger than distance between the pair of stoppers 313, so, it contacts the stoppers 313 certainly. Because the small card does not contact the protruding portions 322, the protruding portions 322 do not move to open outwardly from the large card cavity 29, thus not make the locking holes 325 depart with the mating portion 315, that is to say, the mating portions 315 are still fitly received in the locking holes 325 to prevent the shutter members 31 from pivoting outwardly. So, the stoppers 313 do not pivot outwardly but still protrude into the large card cavity 131 to prevent the small card from advancing inwardly along the large card cavity 131. Thus, the small card then moves into the small card cavity 132 along a pair of guiding slope (not labeled) formed on the stoppers 313 and extending from the second card cavity to the first card cavity, and connects with the first contacting portion 42 of the contacts 4 finally, and the small card is drawn out in virtue of the ejector 2.

Figure 8:
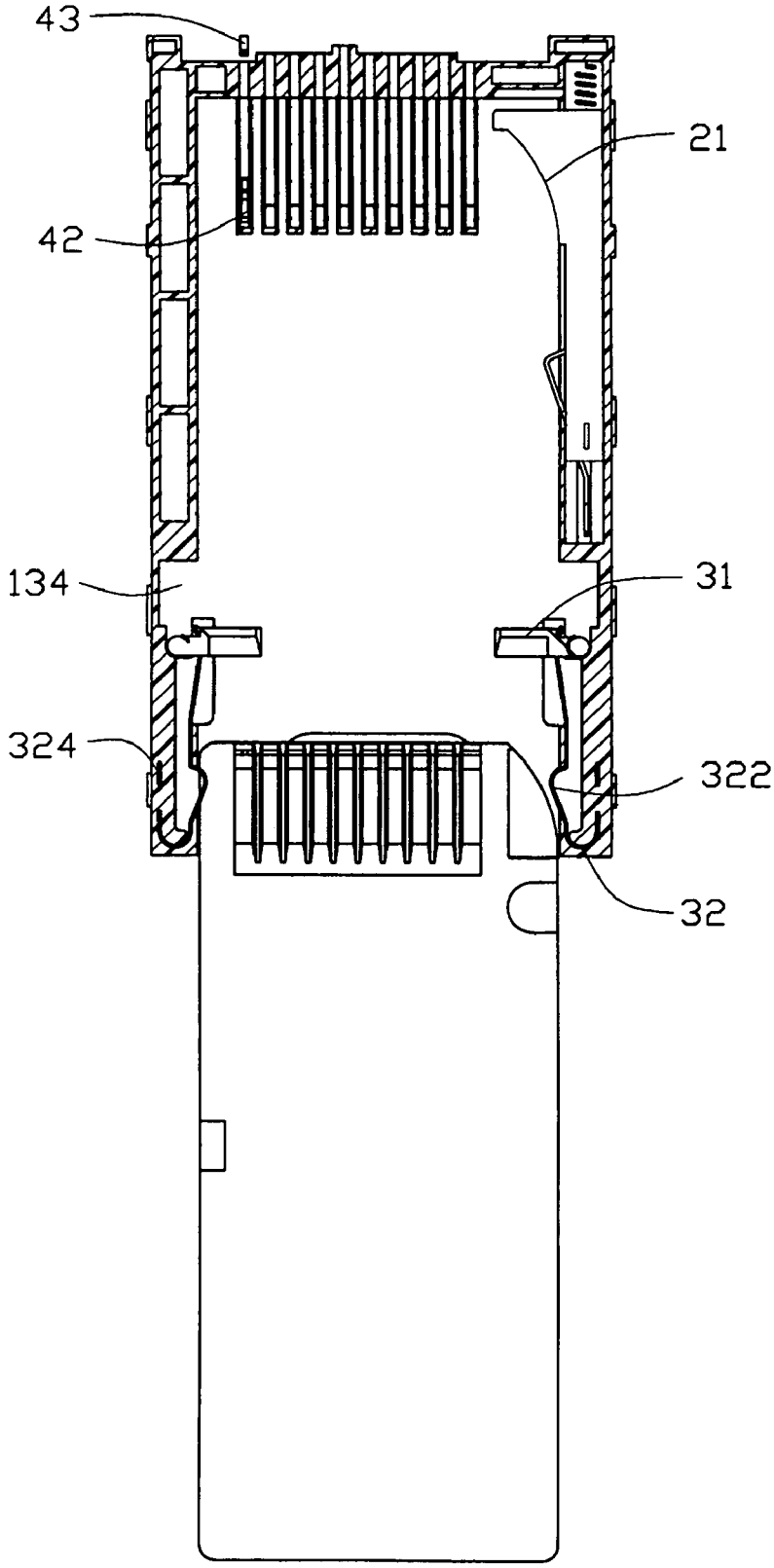
FIG. 8 is a cross-sectional view of the card connector shown in FIG. 1, showing status after a large card collides with an actuator member.
Figure 9:
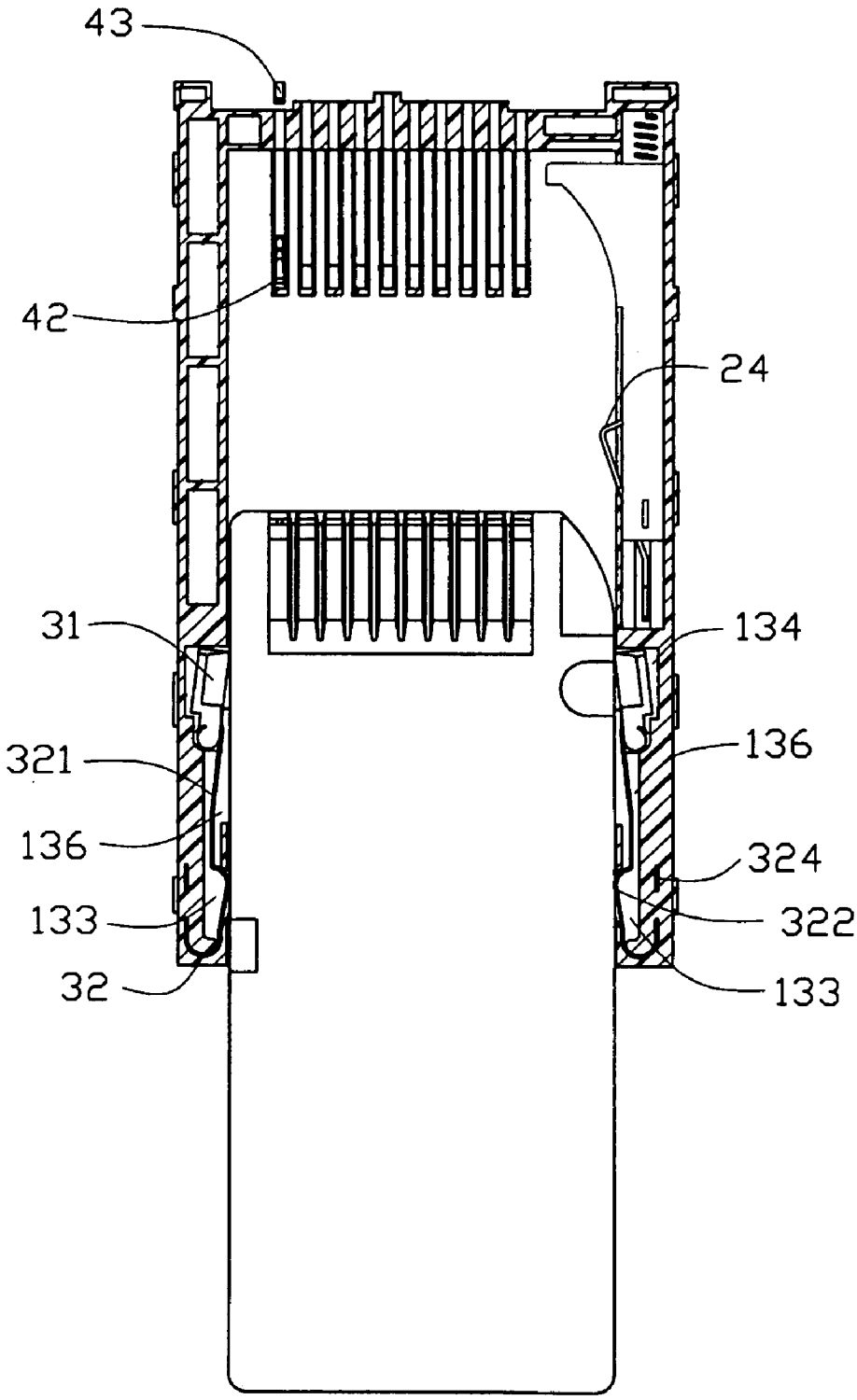
FIG. 9 is a cross-sectional view of the card connector shown in FIG. 1, showing status after the large card collides with the stopper.
Figure 10:
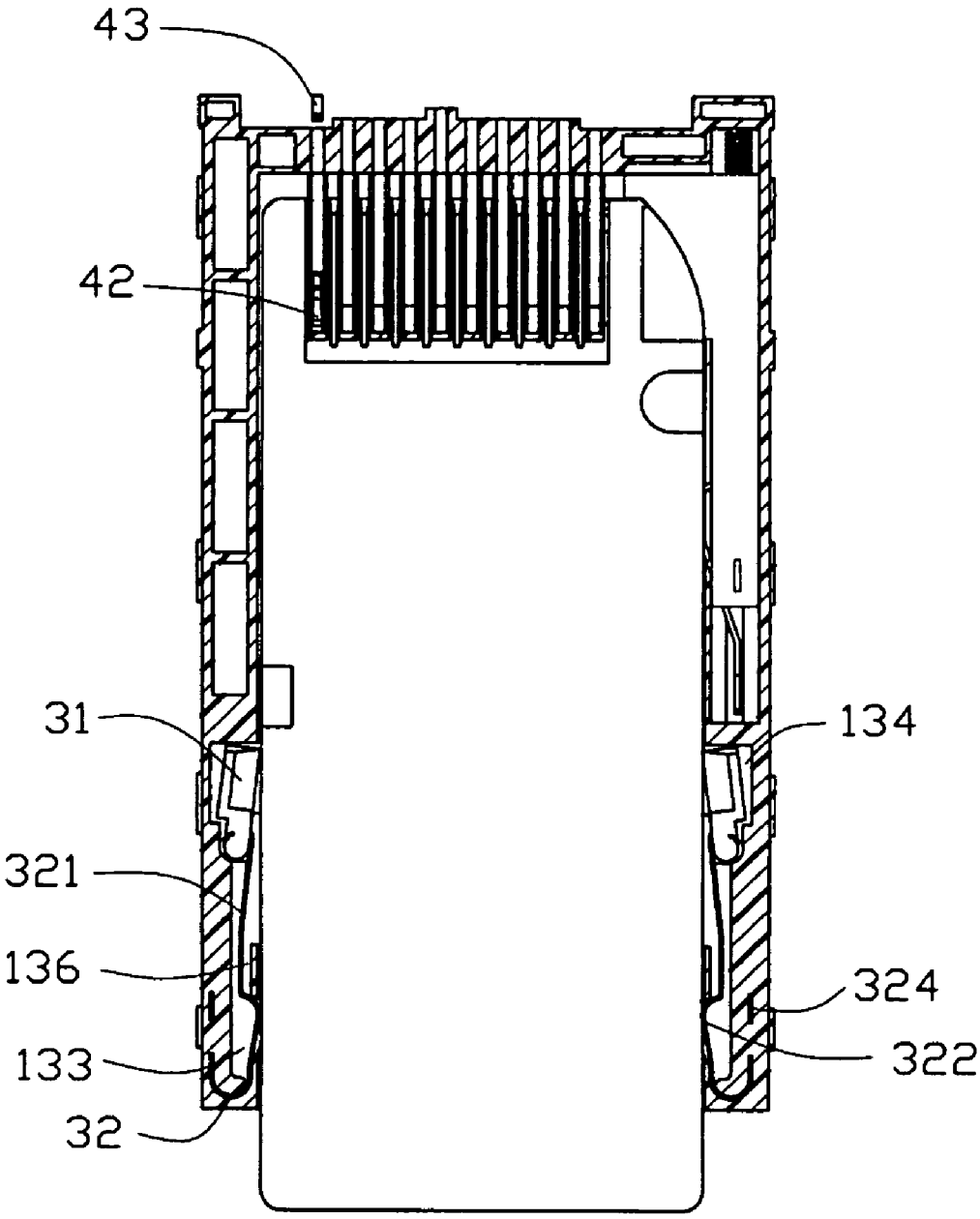
FIG. 10 is a cross-sectional view of the card connector shown in FIG. 1, showing final status of insertion of the large card.

Referring to FIGS. 8, 9 and 10, the large card such as MS card has a width larger than that of the small card cavity 132, so the large card can only insert from the large card cavity 131. In addition, the width of the large card is larger than the normal distance between the pair of protruding portions 322, so, when the large card is inserted into the card connector from the card insertion opening 17, it engages and pushes the protruding portions 322, causing the actuator member 32 to move to open outwardly from the large card cavity 131. In this situation, the locking hole 325 of the engaging portion 321 and the mating portion 315 located in the receiving hole 314 of the shutter member 31 are departed each other, thus nothing prevents the shutter member 31 from pivoting outwardly. The large card advances further inward until it contacts the stoppers 313. The large card has a width larger than a normal distance between the pair of stoppers 313 and the locking holes 325 do not engage with the mating portions 315, thus the stoppers 313 pivot to open outwardly from the large card cavity 131 and do not prevent the large card from advancing along the large card cavity 131 when the large card contacts the stoppers 313. Finally, the large card engages with the first protruding portion 212 of the ejector 2 and a concave (no labeled) of the large card contacts a resilient piece 24 (shown in FIG. 9) formed on the ejector 2 to position the large card. The large card electrically connects with the second contacting portions 42 of the contacts 4.

After the large card is withdrawn, the protruding portions 322 of the actuator members 32 return to protrude into the card insertion space in virtue of their own elasticity and the stoppers 313 of the shutter members 31 return to protrude into the card insertion space in virtue of elasticity of the springs 33 disposed on the anti-misinsertion appliances 3. Because the small card insertion cavity and the large card insertion cavity are overlapped each other, one card such as MS card or MS Duo card is inserted one time.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. A card connector, comprising:

an insulating housing defining a card receiving space which defines a first card cavity and a second card cavity along a vertical direction for accommodating two kinds of different cards in size, respectively;

a plurality of contacts retained in the housing and exposed in the card receiving space for electrically connecting with the corresponding different cards, respectively; and two anti-misinsertion appliances disposed on two sides of the housing, and each anti-misinsertion appliance comprising a shutter member and an actuator member for controlling the shutter member to open and close, the actuator defining a locking hole for mating with a mating portion disposed on the shutter member and having a guiding slope extending from the second card cavity to the first card cavity;

wherein when the actuator member is moved outwardly from the second card cavity because of an outer force, the shutter member can open the second card cavity completely for receiving the corresponding card;

wherein the shutter member defines a receiving hole and the mating portion is exposed in the receiving hole;

wherein the shutter member is pivoted about a pivoting axis thereof.

2. The card connector as described in claim 1, wherein the anti-misinsertion appliance comprises a spring disposed on the shutter member to make the shutter member return to an original position.

3. The card connector as described in claim 1, wherein each of the contacts is provided with a first and second contacting portion spaced each other along a card insertion direction and exposed in the first card cavity and the second card cavity respectively and a soldering portion extending out of the housing.

4. The card connector as described in claim 1, wherein the shutter member and the actuator member comprise a stopper and a protruding portion both protruding into the card receiving space, respectively.

5. The card connector as described in claim 4, wherein the receiving hole is defined between the stopper and the pivoting axis of the shutter member.

6. A card connector, comprising:

an insulating housing defining a card receiving space which defines a first card cavity and a second card cavity along a vertical direction for accommodating two kinds of different cards in size, respectively;

a plurality of contacts retained in the housing and exposed in the card receiving space for electrically connecting with the corresponding different cards, respectively; and two anti-misinsertion appliances disposed on two sides of the housing, and each anti-misinsertion appliance comprising a shutter member and an actuator member for controlling the shutter member to open and close;

when the actuator member is moved outwardly from the second card cavity because of an outer force, the shutter member can open the second card cavity completely for receiving the corresponding card;

wherein the shutter member defines a receiving hole and the mating portion is exposed in the receiving hole;

wherein the shutter member is pivotable about an axis extending in a vertical direction perpendicular to an insertion direction of the corresponding card.

7. A card connector, comprising:

an insulating housing defining a card receiving space which defines a first card cavity and a second card cavity for accommodating two kinds of different cards in size, respectively;

a plurality of contacts retained in the housing, and exposed in the card receiving space for electrically connecting with the corresponding different cards respectively; and two anti-misinsertion appliances disposed on two sides of the housing, and each anti-misinsertion appliance comprising a shutter member and an actuator member, which is used to block or unblock the shutter member according to a type of an inserted card, for controlling the shutter member to open and close;

wherein said shutter member further provides a guidance function to lead the corresponding inserted card to move in a vertical direction perpendicular to an insertion direction of the corresponding card, when said shutter member is blocked by the actuator member;

wherein the shutter member defines a receiving hole and the mating portion is exposed in the receiving hole;

wherein the shutter member is pivotable about an axis extending in a vertical direction perpendicular to an insertion direction of the corresponding card.

* * * * *